United States Patent [19]

Garnier et al.

[11] Patent Number: 4,844,363

[45] Date of Patent: Jul. 4, 1989

[54] HOPPER RAM FOR SHREDDER

[75] Inventors: Thomas J. Garnier; Craig R. Peterson, both of Portland, Oreg.

[73] Assignee: Shredding Systems, Inc., Wilsonville, Oreg.

[21] Appl. No.: 203,520

[22] Filed: May 17, 1988

Related U.S. Application Data

[63] Continuation of Ser. No. 70,235, Jul. 6, 1987, abandoned.

[51] Int. Cl.[4] ..... B02C 18/22

[52] U.S. Cl. ..... 241/224; 241/35; 241/236

[58] Field of Search ..... 241/236, 34, 35, 224, 241/225, 28, 248, 282

[56] References Cited

U.S. PATENT DOCUMENTS

| | | | |
|---|---|---|---|
| 619,012 | 2/1899 | Davis | 241/224 |
| 878,676 | 2/1908 | Scharf | 241/224 X |
| 3,573,223 | 3/1971 | Anderson | 241/35 X |
| 4,515,318 | 5/1985 | Savonjousi | 241/35 X |

*Primary Examiner*—Mark Rosenbaum

*Attorney, Agent, or Firm*—Chernoff, Vilhauer, McClung & Stenzel

[57] ABSTRACT

A shredder having a hopper for funneling material to the cutting blades of the shredder is provided with a ram assist within the hopper to push material into the cutting blades. The ram is shielded from the material passing through the hopper by an intermediate partial wall extending from the infeed of the hopper to the mid portion of the hopper. In its retracted position the ram is positioned behind the partial wall out of the stream of material passing through the hopper. In its extended position the ram is proximate the outfeed of the hopper within the flow of material. A ram controller senses the load upon the cutting blades of the shredder and selectively activates and deactivates the ram.

3 Claims, 2 Drawing Sheets

HOPPER RAM FOR SHREDDER

BACKGROUND OF THE INVENTION

This application is a continuation of application Ser. No. 070,235, filed July 6, 1987, now abandoned.

This invention relates to shredders, and particularly to a hopper ram for urging material into the cutting chamber of a shredder.

Material to be shredded is typically fed to the cutting chamber of a shredder by means of a funnel-shaped hopper which guides the material to the shredding blades. Such systems rely upon gravity working on the weight of the column of material in the hopper, to urge material into the cutting chamber.

Bulky lightweight materials such as cardboard boxes, or metal, cardboard, and fiber drums, create a special problem for such shredders. While a large shredder will easily handle these materials, large shredders have expensive powerful drive motors which are actually more powerful than required for such bulky lightweight materials. Smaller less powerful shredders could handle such materials except that the large physical size of these materials makes them difficult to feed to a small shredder. Since such materials are relatively lightweight, the column of material in the hopper does not adequately press these bulky materials into the cutter blades.

Regardless of the weight or size of the material to be shredded, another problem which occurs is that the flow of material through a shredder is not always at the optimal rate. This is especially so when the material fed to the shredder varies significantly in size and density.

SUMMARY OF THE INVENTION

The present invention addresses the aforementioned problems by providing a shredder having a hopper for directing a stream of material to the cutters, and further including a ram assist positioned so as to selectively engage material in the hopper near the cutters and urge such material into the cutters without inhibiting the flow of material through the hopper. In the exemplary embodiment shown herein, the ram is positioned so that it is out of the material stream in retracted position and within the material stream in extended position.

To ensure that the shredder processes material at the optimum rate, the ram is interfaced with the cutters to feed material to the cutters at the maximum effective rate which the cutters can deal with that particular category of material. A sensor is provided which is capable of sensing the load upon the cutters and a ram controller is provided to activate the ram in response to a signal from the sensor when the load on the cutters has fallen below a preselected level.

In the exemplary embodiment, the load sensor and ram controller cooperate to prevent physical damage to the ram and the cutters by retracting the ram if excessive loads on the cutters are encountered.

The ram enables a shredder to handle bulky material, normally-requiring a larger shredder, by deforming or compressing the bulky material and positively urging it into contact with the cutters of the shredder. The positive feed provided by the ram also enables the shredder to process materials, not limited to bulky materials, at an optimal rate.

Accordingly, it is a principal objective of the present invention to provide a ram assist for a material shredder.

It is another object to provide a ram assist which is positioned so as to urge material into the cutting chamber without inhibiting the flow of material through the hopper.

It is a further object to provide a ram assist which, in its retracted position, is out of the material flow through the hopper.

It is an associated object to provide a ram assist which acts at an acute angle to the flow of material through the hopper.

It is a further object to provide a ram assist whose operation is interfaced with the cutters.

It is a particular object to provide sensing and controlling elements to selectively activate and deactivate the ram assist according to the load upon the cutters.

The foregoing and other objectives, features, and advantages of the invention will be more readily understood upon consideration of the following detailed description of the following detailed description of the invention, taken in conjunction with the accompanying drawings.

DETAILED DESCRIPTION OF THE INVENTION

Figure 1:
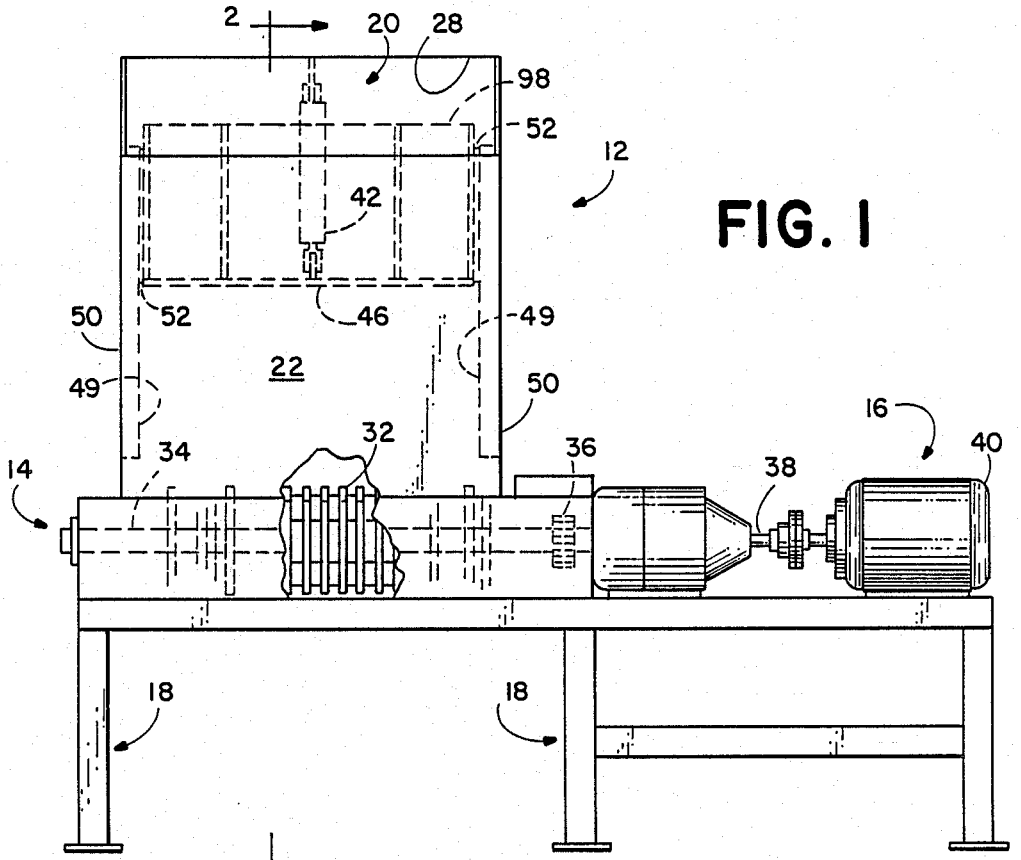
FIG. 1 is a front elevational view of the exemplary embodiment of the present invention, partially broken away to show hidden detail.
Figure 2:
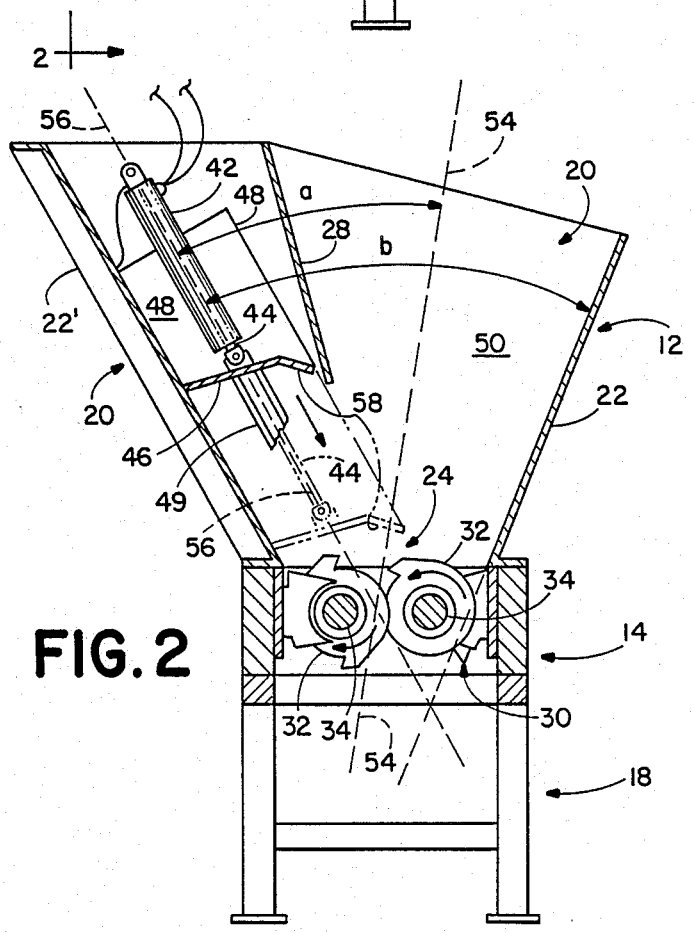
FIG. 2 is a side sectional view of the embodiment shown in FIG. 1 taken along lines 2—2.

Referring to FIGS. 1 and 2, the exemplary embodiment of the present invention is shown in connection with a material shredder having a hopper 12, cutters 14, and a motor 16 for driving the cutters. The shredder is supported above a supporting surface by a base 18. The shredder also includes a ram 20 for urging material within the hopper into the cutters.

The hopper 12 includes a pair of converging side walls 22 and 22' which converge to define the outfeed 24 of the hopper at the cutters. The infeed 26 of the hopper is defined by one of the sloping sidewalls 22 and a shield wall 28 which is interposed between sidewall 22 and the ram 20, the shield wall extending from the top of the hopper downwardly toward the middle portion of the hopper.

The outfeed of the hopper leads to a cutting chamber 30 where a pair of rotary shredders 32 reduce material fed to the shredders into discrete units of substantially similar size. The rotary shredders are keyed to respective shafts 34 which are connected through gears 36 and couplings to the drive shaft 38 of an electric motor 40.

In the exemplary embodiment the ram 20 includes a hydraulic cylinder 42 which is fixed to the upper portion of the hopper. The piston 44 of the ram carries a platen 46. A shell 48 is attached to the platen and encloses the piston and the lower cylinder of the ram. The piston moves the platen of the ram between a retracted position shown in FIGS. 1 and 2 to an extended position shown in dashed lines in FIG. 2. A pair of grooved tracks 49 mounted on parallel opposed walls 50 of the hopper receive respective rails 52 fixed to the shell 48 of the ram to guide the platen between extended and retracted positions.

In operation, material to be shredded is placed into the infeed of the hopper and is guided toward the outfeed of the hopper and into the cutters by sloping sidewall 22, opposed parallel walls 50, shield wall 28, and the lower portion of sloping sidewall 22'. Thus, the flow of material through the hopper and into the cutters represents a material stream having an approximate axis 54 extending between the center of the infeed and the center of the outfeed.

Referring to FIG. 2, it can be seen that the axis of the material stream passes approximately between the two rotary shredders. It should also be noted that the rotary shredders rotate in opposite directions so as to engage material in the outfeed of the hopper with their teeth and force all material down between the rotary shredders.

As explained above, due to the shape of the material to be shredded and/or its weight, some types of materials are not passed through the cutters at the optimal rate. When this occurs, the ram can be used to push material which is located in the lower part of the hopper into the cutters. When in the retracted position shown in FIG. 2, the ram and its platen are out of the material stream, protected from above by the shield wall 28. From FIG. 2 it can be understood that once past the lower edge of the shield wall, material within the hopper will fall toward the outfeed of the hopper with some of the material falling to a position which is directly beneath the ram and in its path as it moves to its extended position. Thus, in extended position, the platen of the ram is directly within the material stream. As the ram moves toward the extended position, also shown in FIG. 2, it pushes the material beneath it into the rotary cutters.

The movement of the piston 44 of the ram defines a ram axis 56 which forms an acute angle with the material stream axis 54, intersecting the stream axis within the cutting chamber. The orientation of ram movement with respect to the material stream enables the platen of the ram to be out of the material stream, protected by the shield wall, when in retracted position, but within the material stream when in extended position. The shell protects the piston and cylinder from damage by the material passing through the hopper and prevents material from lodging upon the top of the platen and thereby preventing the ram from assuming the retracted position. The platen of the ram includes a downwardly depending lip 58 oriented substantially perpendicular to the material flow, which is positioned to force material between the rotary cutters as the ram moves to extended position.

Applicant has found that the optimum acute angle between the axis of the material stream and the axis of the ram movement is approximately 40 degrees shown as angle "a" in FIG. 2. Angles less than 25 degrees position the ram within the material stream passing through the hopper thereby restricting material flow through the hopper. Angles greater than 60 degrees do not adequately enable the ram to push material into the cutters.

The exemplary embodiment may also be viewed as a ram within a hopper of the type having opposed converging sidewalls, with the movement of the ram being substantially parallel to one of the sloping sidewalls and forming an acute angle with the other sloping sidewall. Referring again to FIG. 2, it can be seen that the ram axis 56 is substantially parallel to sloping sidewall 22' and forms an acute angle with the sloping wall 22 of approximately 52°, shown as angle "b." Applicant believes that angle b should be greater than 35 but less than 70°.

As will be explained with reference to FIG. 3, the operation of the ram is interfaced with the operation of the cutters so as to optimize the performance of the shredder. In view of the different types of materials which are likely to be fed to the shredder, in some cases the ram would not need to be used at all, in other cases the ram would need to be used continuously, and in still other cases the ram would need to be used only occasionally as demand arises. Accordingly, applicant has provided three modes of ram operation: Manual; Automatic; and Normal.

In the Manual mode the operator activates the hydraulic power unit 60 through the ram controller 62 by using a manual switch 64. In the Automatic mode the ram controller directs the hydraulic power unit to cycle the ram at preselected intervals.

In Normal mode a sensor 66, associated, in the exemplary embodiment, with the electric motor 40 which drives the cutters, senses the load upon the cutters by sensing the current used by the drive motor. A motor controller which measures current through the motor would be appropriate as a sensor for this purpose. If the load on the cutters is light, as signified by current below a preselected level, a signal is sent to the ram controller instructing it to cycle the ram. The ram controller will continue to cycle the ram until the load on the cutters, as reflected by the current level of the electric motor, exceeds a preselected level, at which point the sensor causes the controller to stop the ram in the retracted position.

The sensor is also programmed to detect a preselected maximum permissible load on the cutters and signal the controller to cause the ram to move to the retracted position and remain there. This feature is to protect the shredder from damage by overloading and will override operation of the ram in any mode including Manual and Automatic.

Figure 3:
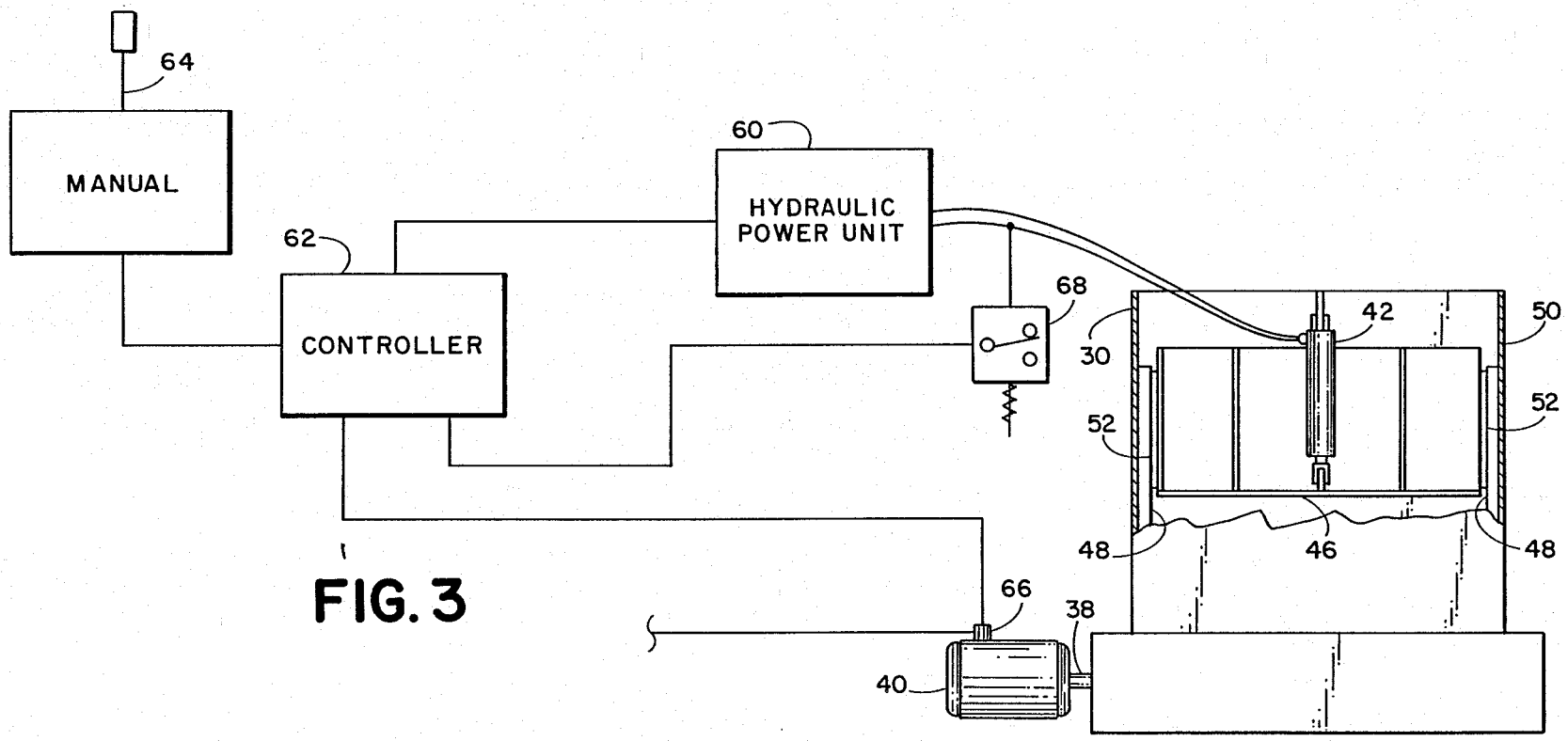
FIG. 3 is a partial schematic of the embodiment shown in FIG. 1 showing the sensing and controlling elements.

Referring still to FIG. 3, another safety system is associated with operation of the ram. A ram load sensor 68 is capable of detecting excessive hydraulic pressure in the line which activates the ram 42. Such excessive pressure could be caused by an article becoming jammed in the hopper thereby preventing the ram from cycling. Excessive pressure in the hydraulic line would cause the ram load sensor to send a signal to the controller 62 to retract the ram, thereby preventing physical damage to the ram or shredder. A signal from the ram load sensor can override the three operational modes discussed above.

It should be understood that the particular device described above is exemplary, and that variations and alternatives are within the scope of the invention. Examples of such variations include, but are not limited to, processor apparatus other than rotary shredders, power units other than electrical motors, and rams other than hydraulic cylinders. Other examples of alternative embodiments include sensors which detect rotation or torque of the drive shaft 38 rather than detecting current levels used by the electric motor.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only the by claims which follow.

What is claimed is:

1. An apparatus for processing a stream of material comprising:

(a) a pair of cylindrical counterrotating cutters which have parallel, spaced-apart cutter axes of rotation;

(b) an in-feed hopper arranged to gravity feed material toward said cutters substantially along a stream axis which is oriented generally perpendicular to a plane which is defined by said cutter axes of rotation and passes between said cutter axes of rotation;

(c) ram means for selectively engaging a portion of the material in said hopper and urging it towards said cutters without inhibiting the passage of the remaining material in said hopper; wherein (d) said ram means has a platen which is movable between an extended position where it is adjacent to said cutters and a retracted position where it is separated from said cutters, along a ram axis which is oriented at an angle of less than 60 degrees with respect to said stream axis.

2. The apparatus of claim 1 wherein said ram means is located entirely within said hopper.

3. The apparatus of claim 2 wherein said hopper has a pair of opposed hopper walls which converge toward said cutters, and said ram means includes a shield wall which is located between said hopper walls and which separates said platen from the material in said hopper when said platen is in its retracted position.

* * * * *